US007614174B1

(12) United States Patent
Beltz

(10) Patent No.: US 7,614,174 B1
(45) Date of Patent: Nov. 10, 2009

(54) BIPOD FIREARM SUPPORT

(76) Inventor: Kasey Dallas Beltz, 1262 Sunset Dr., Wichita, KS (US) 67212

( * ) Notice: Subject to any disclaimer, the term of this patent is extended or adjusted under 35 U.S.C. 154(b) by 178 days.

(21) Appl. No.: 11/443,990

(22) Filed: May 31, 2006

Related U.S. Application Data

(60) Provisional application No. 60/685,852, filed on May 31, 2005.

(51) Int. Cl.
*F41C 27/22* (2006.01)

(52) U.S. Cl. ..... 42/94; 42/90; 42/72; 89/37.01; 89/37.04

(58) Field of Classification Search ..... 42/94, 42/90, 72; 89/37.01
See application file for complete search history.

(56) References Cited

U.S. PATENT DOCUMENTS 148,712 A * 3/1874 Ketchum ..... 403/117
2,420,267 A * 5/1947 Sefried ..... 42/94
2,489,283 A * 11/1949 Garand ..... 42/94
2,807,904 A * 10/1957 Kreske ..... 42/94
2,844,905 A 7/1958 Musser et al.
3,012,350 A 7/1961 Lies
3,327,422 A * 6/1967 Harris ..... 42/94
3,445,082 A * 5/1969 Frazer et al. ..... 248/183.3
3,938,273 A * 2/1976 Tellie ..... 42/94
3,999,461 A 12/1976 Johnson et al.
4,055,017 A * 10/1977 Thompson ..... 42/94
4,068,961 A * 1/1978 Ebner et al. ..... 403/55
4,109,364 A * 8/1978 Wisner ..... 29/888.051
4,265,045 A * 5/1981 Garbini ..... 42/94
4,351,224 A * 9/1982 Curtis ..... 89/37.04
4,393,614 A 7/1983 Pickett
4,470,216 A * 9/1984 Harris ..... 42/85
4,564,166 A * 1/1986 Craft et al. ..... 248/179.1
4,607,561 A * 8/1986 Frimer ..... 89/37.04
4,625,620 A * 12/1986 Harris ..... 89/37.04
4,641,451 A * 2/1987 Harris ..... 42/85
4,747,489 A * 5/1988 Saalfeld ..... 206/446
4,844,390 A * 7/1989 Duke ..... 248/118
4,903,425 A * 2/1990 Harris ..... 42/94
4,987,694 A 1/1991 Lombardo
5,029,407 A 7/1991 Kirkpatrick
5,074,188 A * 12/1991 Harris ..... 89/37.04
5,081,782 A 1/1992 Wright
5,102,081 A * 4/1992 Barchus ..... 248/181.1
5,145,134 A * 9/1992 Hashimoto et al. ..... 248/181.1
5,194,678 A * 3/1993 Kramer ..... 42/94
5,345,706 A 9/1994 Brown
5,347,740 A 9/1994 Rather et al.
5,467,228 A * 11/1995 Lin ..... 359/822
5,491,920 A * 2/1996 McCullers ..... 42/94

(Continued)

*Primary Examiner*—Michael Carone
*Assistant Examiner*—Jonathan C Weber
(74) *Attorney, Agent, or Firm*—Robert O. Blinn

(57) ABSTRACT

A bipod for supporting the forward portion of a firearm includes a clamp portion, a pivot body and a pair of leg assemblies. The clamp portion is adapted for clamping to a firearm and is pivotably mounted to the pivot body for pivoting about a vertical axis and a longitudinal axis. The pivot body includes a pair of leg mounting surfaces. A pair of leg assemblies are pivotably mounted to the mounting surfaces of the pivot body so that each leg assembly may be pivoted about an axis that is generally normal to the mounting surface and such that each leg assembly can be adjustably positioned in one of at least two positions.

4 Claims, 8 Drawing Sheets

U.S. PATENT DOCUMENTS 5,593,239 A * 1/1997 Sallee ..... 403/109.3
5,704,188 A * 1/1998 Coulis ..... 52/736.3
5,711,103 A * 1/1998 Keng ..... 42/94
5,815,974 A * 10/1998 Keng ..... 42/94
5,937,560 A 8/1999 Beltz
6,487,807 B1 * 12/2002 Kopman et al. ..... 42/94
6,517,133 B2 * 2/2003 Seegmiller et al. ..... 294/139
6,560,911 B2 * 5/2003 Sharp ..... 42/73
6,763,627 B1 * 7/2004 Kaempe ..... 42/94
6,785,997 B2 * 9/2004 Oz ..... 42/94
6,843,015 B2 * 1/2005 Sharp ..... 42/94
6,875,161 B1 4/2005 Brice
2002/0074467 A1 * 6/2002 Harris ..... 248/188.9
2003/0192223 A1 * 10/2003 Sharp ..... 42/94
2005/0188597 A1 * 9/2005 Keng et al. ..... 42/94

* cited by examiner

BIPOD FIREARM SUPPORT

CROSS REFERENCES TO RELATED APPLICATIONS

This application claims the benefit of U.S. Provisional Patent Application No. 60/685,852 filed May 31, 2005.

FIELD OF THE INVENTION

This invention relates to a bipod support for supporting the forward end of a firearm.

BACKGROUND OF THE INVENTION

Firearm marksmen, particularly military sharp shooters, have a need for supporting the forward end of a firearm in a stable adjustable manner. Often, a bipod support is used for such front end firearm support. Military sharp shooters have a particular need for a portable, light weight and retractable bipod which also offers significant amounts of adjustment. In particular, it would be useful to have a bipod support having pivotably mounted legs wherein the legs may be adjusted to various positions including a retracted position in which the legs are generally parallel to the longitudinal axis of the firearm. It would also be useful for the legs of such a bipod to have adjustable telescoping portions for adjusting the length of the legs. Moreover, it would be useful if such a bipod support were adapted to allow pivoting adjustment about a vertical axis and a horizontal axis with respect to the legs of the bipod for aiming adjustment.

BRIEF DESCRIPTION OF THE INVENTION

In an embodiment of the present invention the aforementioned needs are addressed by an improved bipod firearm support. The improved bipod firearm support for supporting the forward portion of a firearm includes a clamp portion, a pivot body and a pair of leg assemblies. The clamp portion is adapted for clamping to a firearm and is pivotably mounted to the pivot body for pivoting about a vertical axis and a longitudinal axis to allow a range of movement for aiming adjustment. The pivot body includes a pair of leg mounting surfaces. A pair of leg assemblies are pivotably mounted to the leg mounting surfaces of the pivot body so that each leg assembly may be pivoted about an axis that is generally normal to the mounting surface and such that each leg assembly can be adjustably positioned in one of at least two positions.

DETAILED DESCRIPTION

Figure 1:
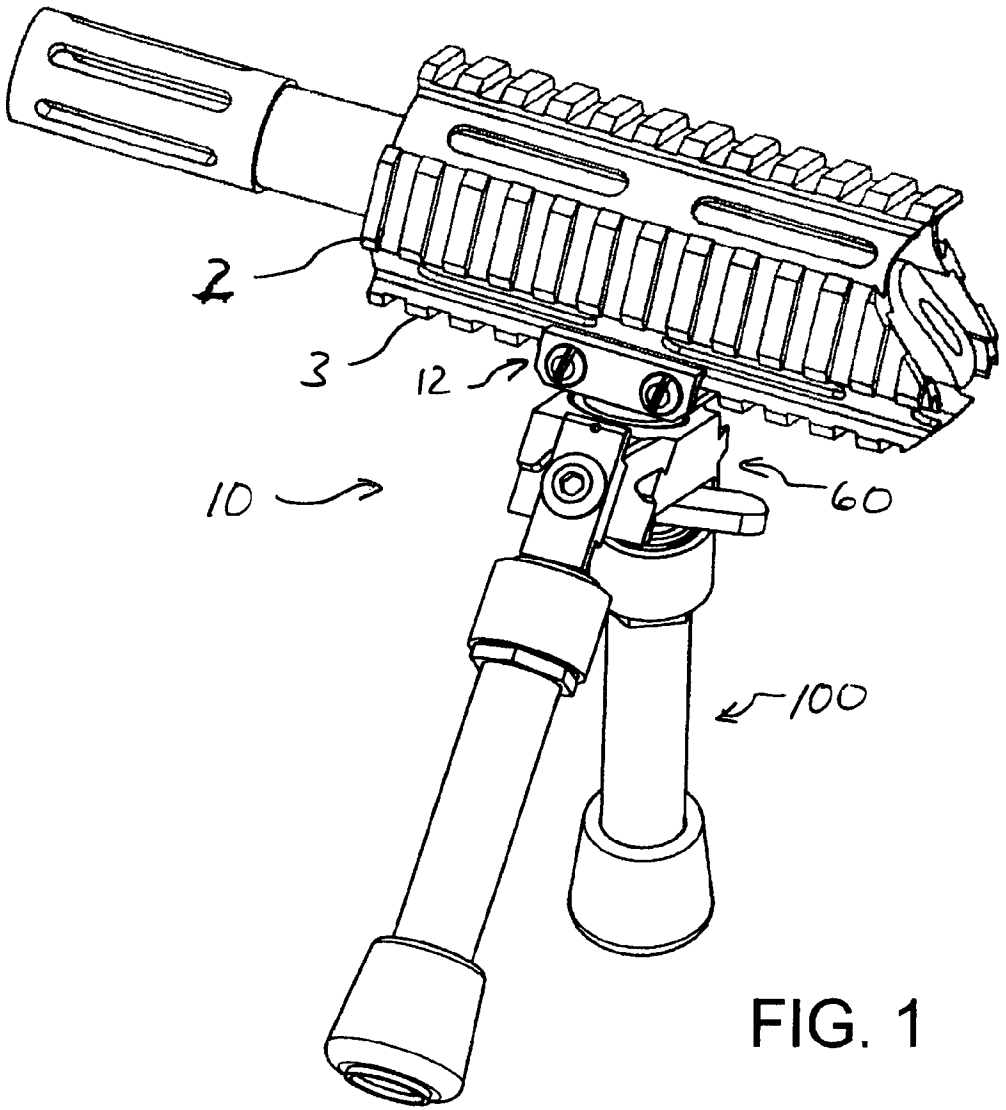
FIG. 1 is a perspective view of the bipod firearm support shown supporting the forward portion of a firearm stock having a mounting rail.

Referring to the drawings, FIG. 1 illustrate a preferred embodiment of a bipod firearm support device 10. Bipod firearm support device 10 generally includes a clamp portion 12 a pivot body 60 and two leg assemblies 100.

Bipod firearm support device 10 is shown in FIG. 1 with clamp portion 12 mounted to a firearm stock 2 which includes a mounting rail 3. Mounting rail 3 is one of several standard mounting provisions presented by various firearms. In this example, mounting rail 3 has a generally dovetail shaped cross section and a plurality of evenly spaced transverse notches for accommodating transverse clamping bolts 18A and 18B of clamp portion 12. Clamping bolts 18A and 18B are spaced apart by a distance which matches the spacing of the transverse notches of mounting rail 3. The skilled reader should note that the mounting arrangement shown and described in greater detail below is only one example of several known in the art. The requirement here is that clamp portion 12 is adapted for securely engaging firearm stock 2.

As noted above, clamp portion 12 is adapted for securing bipod firearm support 10 to a firearm. Accordingly, clamp portion 12 includes a clamp body 14, a jaw member 26 and a fastener 32.

Figures 6, 6A:
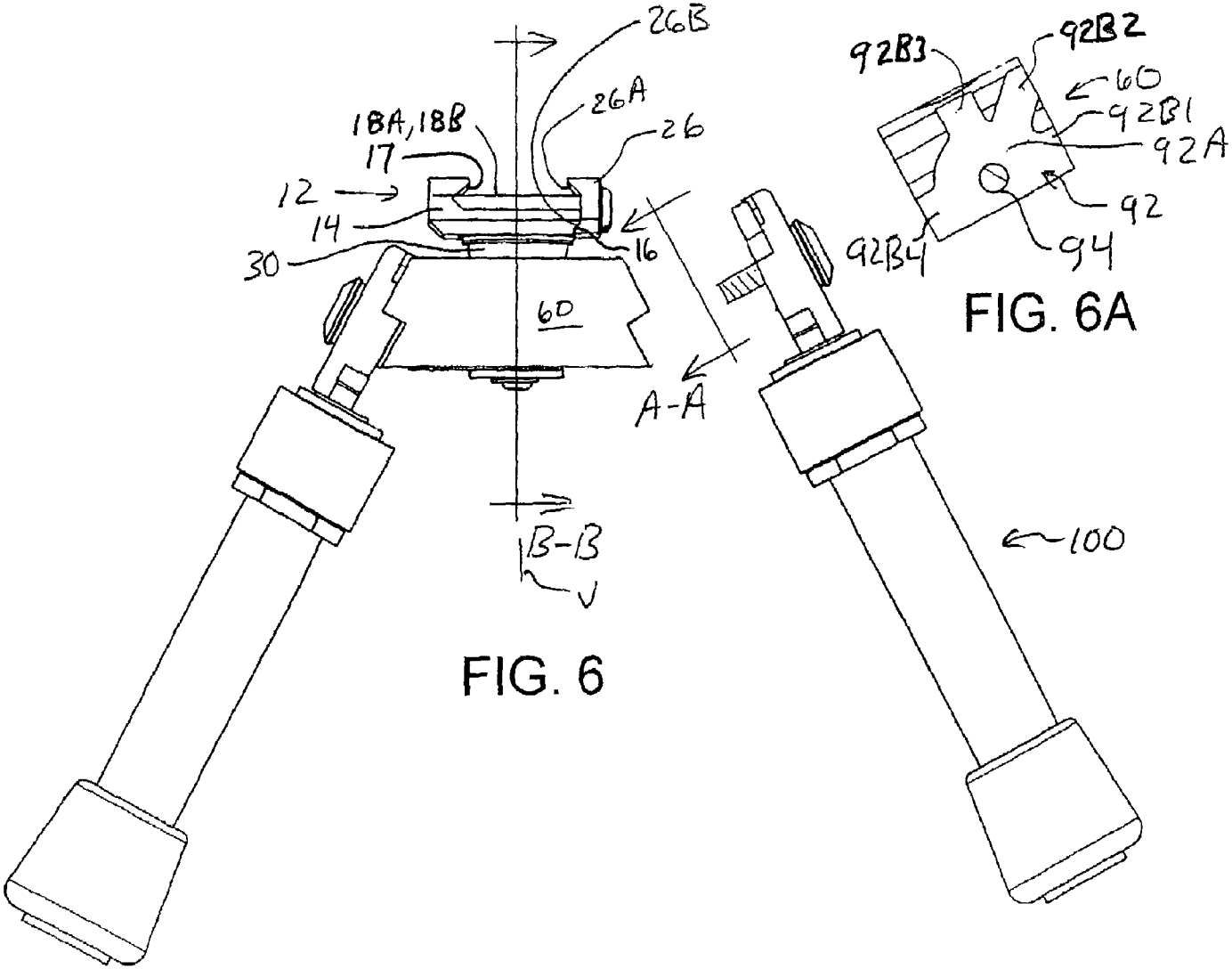
FIG. 6 is a front view of the bipod firearm support shown with one leg assembly pulled away.
FIG. 6A is a plan view of one side of the pivot body taken from plane A-A of FIG. 6.
Figure 6C:
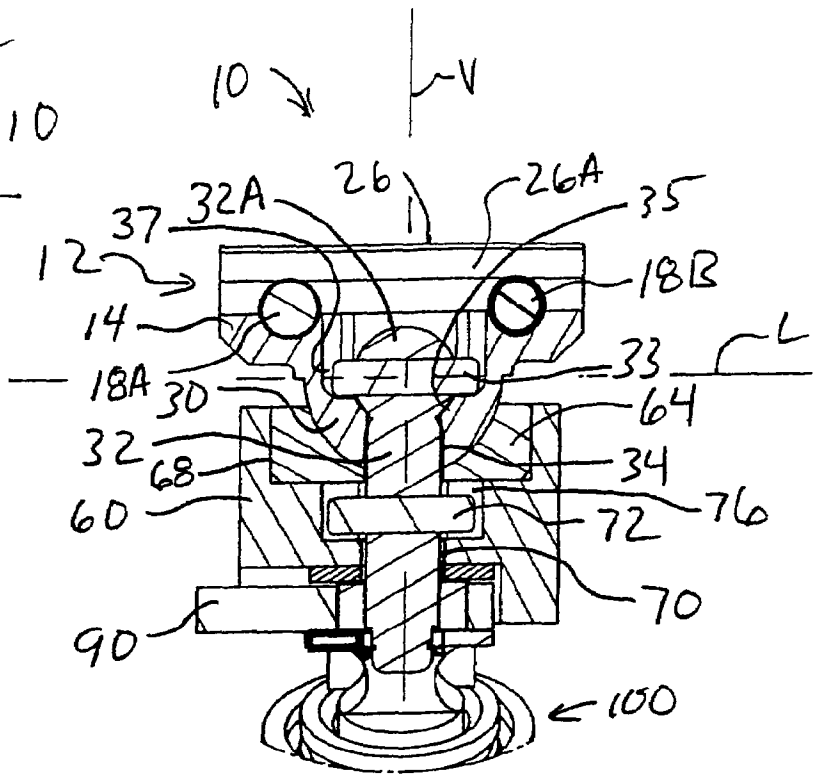
FIG. 6C is a magnified view of the region indicated by reference symbol C in FIG. 6B.
Figure 6B:
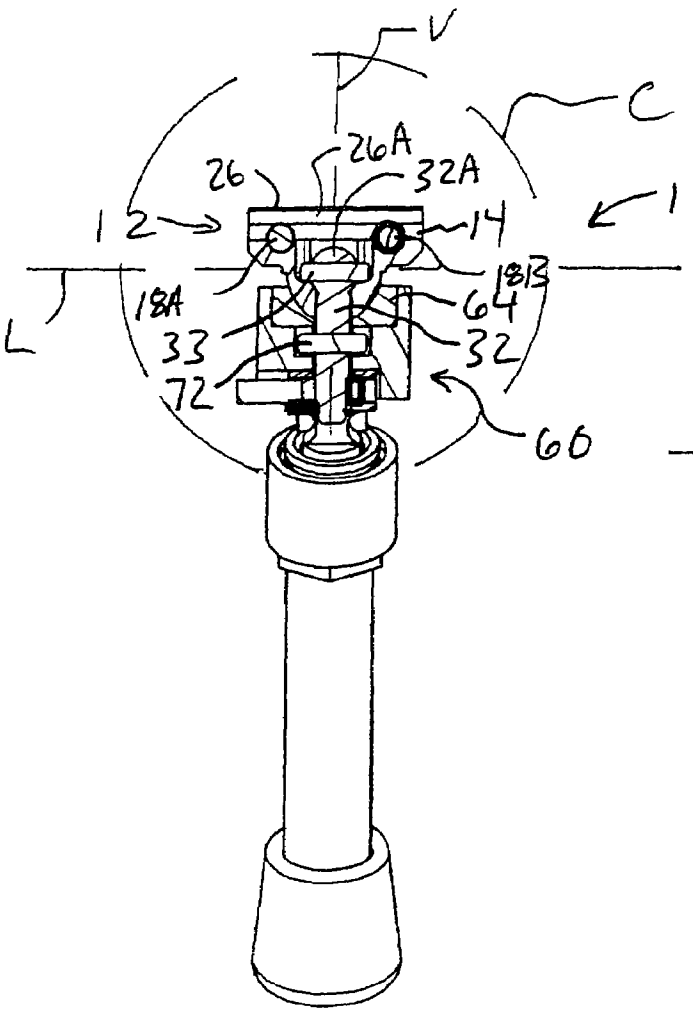
FIG. 6B is a sectional view of the bipod firearm support taken from plane B-B of FIG. 6.

Jaw member 26 cooperates with the clamp body 14 to clamp to the mounting rail of a firearm. As can be best seen in FIG. 6, jaw member 26 is secured to clamp body 14 by a pair of spaced transverse clamping bolts 18A and 18B. Jaw member 26 is shaped to present a channel having an upper wall 26A and a lower wall 26B which angle in toward each other as shown in FIG. 6. Clamp body 14 presents a beveled surface 16 for receiving lower wall 26B of jaw member 26. Transverse clamping bolts 18A and 18B engage corresponding threaded bores on the opposite side of clamp body 14 to secure jaw member 26 to clamp body 14. An angled wall 17 on the opposite side of clamp body 14 presents a second angled surface for engaging the dovetail surfaces of a mounting rail associated with a firearm. This arrangement is used to engage a corresponding dove tail shaped rail 3 mounted to a firearm stock 2 as upper wall 26A is drawn toward angled wall 17 by transverse clamping bolts 18A and 18B. Those skilled in the art will readily appreciate that this arrangement is merely one example of a multitude of ways for securing clamp portion 12 to a firearm.

Clamp portion 12 is mechanically associated with pivot body 60 such that clamp portion 12 may adjustably pivot preferably by a limited amount with respect to pivot body 60 in preferably two directions, a first pivoting direction about an axis V which is generally normal to the upper surface of clamp portion 12 and a second pivoting direction around an axis L which is generally aligned in a longitudinal direction with respect to clamp portion 12. This capability allows a firearm marksman to pivot a firearm about a vertical axis and a longitudinal axis for aiming the firearm while leg assemblies 100 remain relatively stationary. Pivoting about a generally horizontal transverse axis for elevation adjustment of the firearm may be accomplished by pivoting or rocking about a line described by the contact points at the lower ends of leg assemblies 100. Accordingly, in the first pivoting direction, clamp portion 12 may adjustably pivot preferably by a limited amount about a generally vertical axis V. Vertical axis V is indicated in FIGS. 6, 6B, 6C, 7 and 7A. Also, in the second pivoting direction, clamp portion 12 may adjustably pivot preferably by a limited amount about a generally horizontal longitudinal axis L. Longitudinal axis L is generally parallel to firearm stock 2 and is indicated in FIGS. 6B, 6C, 7, 7A and 7B.

In this example embodiment, this limited pivoting adjustment between clamp portion 12 and pivot body 60 is accomplished by ball and socket joint between the two wherein lower surface of clamp body 14 of clamp portion 12 presents a projecting ball portion 30 and the upper surface of pivot body 60 includes a socket member 64 for receiving ball portion 30. This ball and socket joint can be seen in FIGS. 6B, 6C and 7A. The ball and socket joint of clamp body 14 and pivot body 60 is secured by a fastener 32 which is common to both clamp body 14 and pivot body 60. A passageway 34 in clamp body 14 and a corresponding bore 72 in pivot body 60 accommodate fastener 32. Fastener 32 has a ball shaped head 32A at its upper end which is received by a complementary concave recess 35 located at the upper end of passageway 34 in clamp body 14. In this example, head 32A of fastener 32 is pinned to clamp portion 12 by a first pin 33. First pin 33 passes through the center of ball shaped head 32A, is also aligned with the center of ball portion 30 and is also substantially co-axial with longitudinal axis L. First pin 33 is retained by a slot 37 in clamp body 14 so that clamp body 14 can pivot about longitudinal axis L with respect to pivot body 60. Passageway 34 in clamp body 14 is sufficiently wide in the longitudinal direction to accommodate fastener 32 but becomes wider in the transverse direction toward the lower surface of ball portion 30 to allow limited pivoting movement of clamp portion 12 relative to pivot body 60 about longitudinal axis L. The wider portion of passageway 34 in the transverse direction may be best seen in FIG. 7A.

Figure 7B:
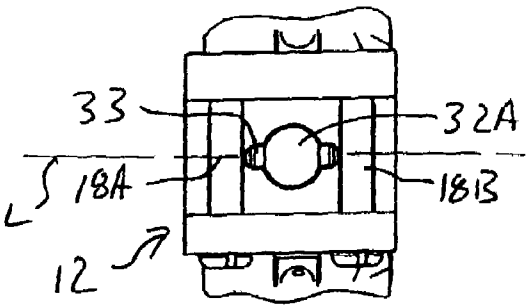
FIG. 7B is a sectional view of the bipod firearm support taken from plane B-B of FIG. 7.
Figure 7C:
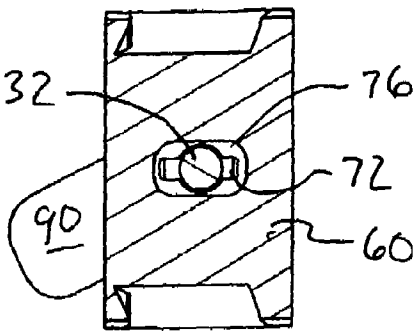
FIG. 7C is a sectional view of the bipod firearm support taken from plane C-C of FIG. 7.
Figure 7A:
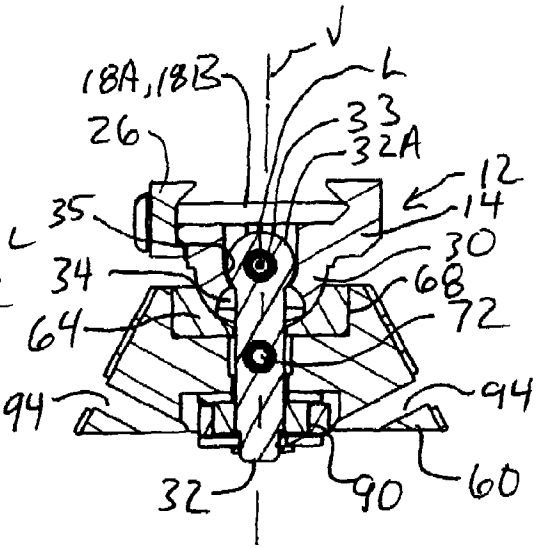
FIG. 7A is a sectional view of the bipod firearm support taken from plane A-A of FIG. 7.
Figure 7:
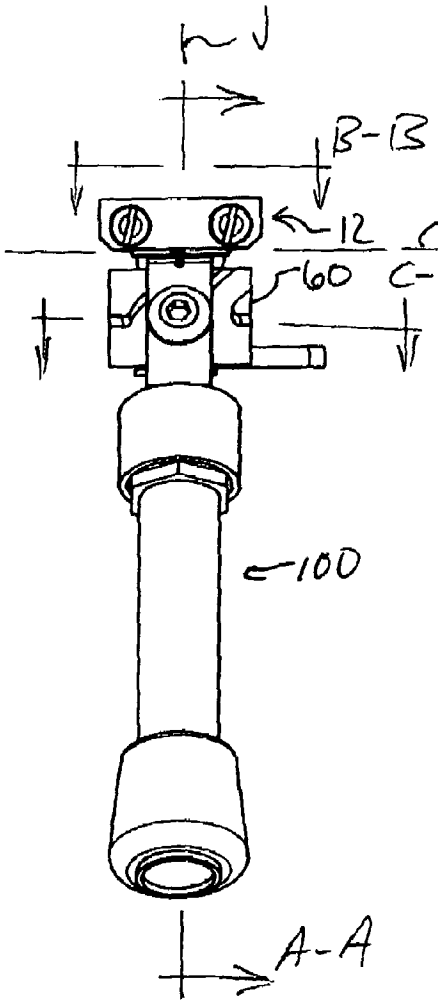
FIG. 7 is a side view of the bipod firearm support.

As noted above, pivot body 60 includes a socket member 64 for receiving ball portion 30. Socket member 64 is received into pivot body 60 by a correspondingly shaped socket member recess 68. Pivot body 60 also includes a bore 70 communicating between the bottom of socket member recess 68 and the lower surface of socket member 64 for receiving fastener 32. In this example, limiting the pivoting of clamp portion 12 relative to pivot body 60 about generally vertical axis V is accomplished by a means of a second pin 72 which is mounted near the lower end of fastener 32 in a generally perpendicular relationship with fastener 32 as shown in FIG. 7C. Second pin 72 is preferably located below the lower surface of socket member 64. A second recess 76 at the bottom of socket member recess 68 is shaped to receive second pin 72 and to allow limited rotating movement of second pin 72. This limited rotating movement occurs as clamp portion 12 and fastener 32 rotate in unison about generally vertical axis V.

At least the lower end of fastener 32 is threaded and a correspondingly threaded nut lever 90 is threaded onto the lower end of fastener 32 to complete the assembly of this ball and socket joint arrangement. With appropriate spacing and thread pitch, nut lever 90 may be arranged such that it may be pivoted between a first and second position through a relatively modest angle, the tension clamping clamp portion 12 to pivot body 60 is adjusted between a first relatively low clamping force and a second relatively high clamping force. A clamping force which is relatively low will allow relatively easy pivoting movements between clamp portion 12 and pivot body 60. A clamping force which is relatively high will tend to lock clamp portion 12 and pivot body 60 together in a generally fixed relative orientation.

A second important capability of bipod firearm support 10 is the capability of adjusting the angles of leg assemblies 100 in relation to pivot body 60. In this example, the arrangement between leg assemblies 100 and pivot body 60 is designed such that each leg assembly 100 may be positioned in one of a relatively limited number of orientations. A limited number of orientations is preferable because a multitude of possible orientations would increase the difficulty of positioning opposite leg assemblies 100 in a symmetrical fashion. In the following description of leg assembly 100 and the mounting of leg assembly 100 to pivot body 60, the skilled reader should bear in mind that only one leg assembly 100 and the corresponding features of pivot body 60 for receiving leg assembly 100 will be described. It is to be understood that symmetrical and opposite structures and features are present on the opposite side of bipod firearm support 10.

Pivot body 60 includes two opposite and symmetrical leg mounting surfaces 92. In this example, leg mounting surfaces 92 are angled such that the cross section of pivot body 60 given by a transverse vertical plane generally defines an isosceles trapezoid (or an isosceles trapezium). Thus leg mounting surfaces 92 angle outwardly so that each leg assembly 100 may angle outwardly as shown in FIG. 6.

Figure 3:
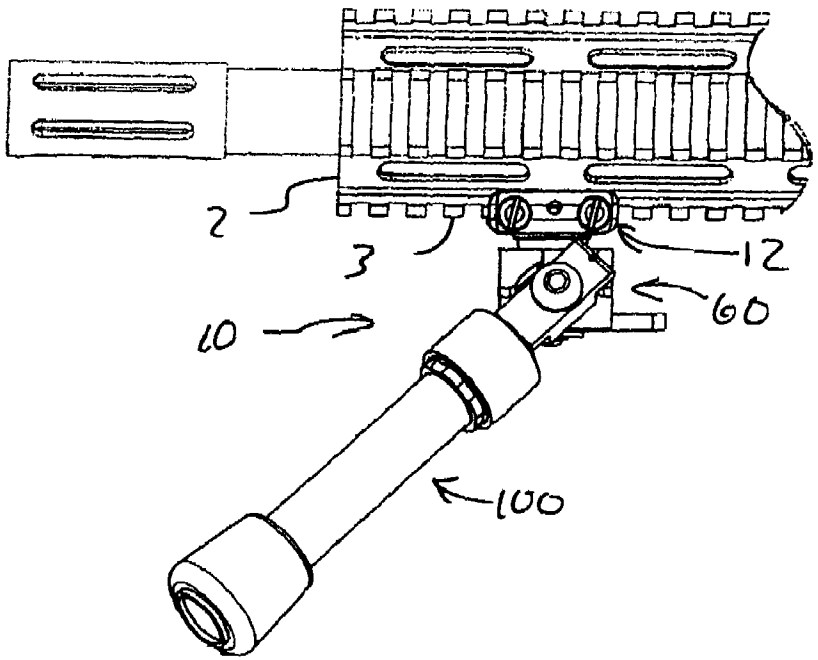
FIG. 3 is a side view of the bipod firearm support shown with the support legs in an intermediate angled position the retracted position and with the telescoping outside legs retracted.
Figure 2:
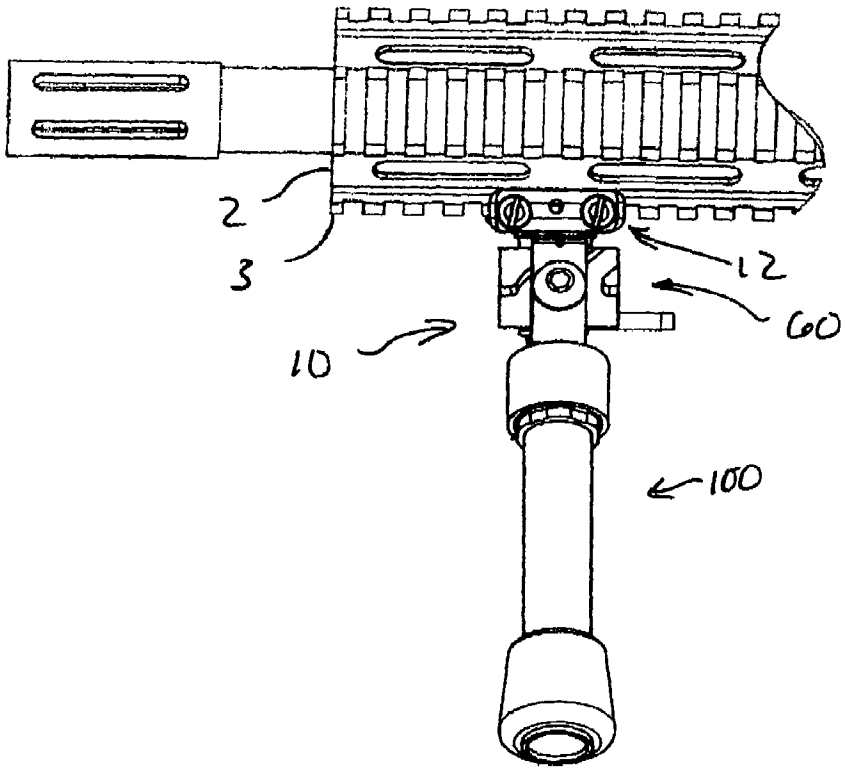
FIG. 2 is a side view of the bipod firearm support shown with the support legs in an upright position and with the telescoping outside legs retracted.
Figure 4:
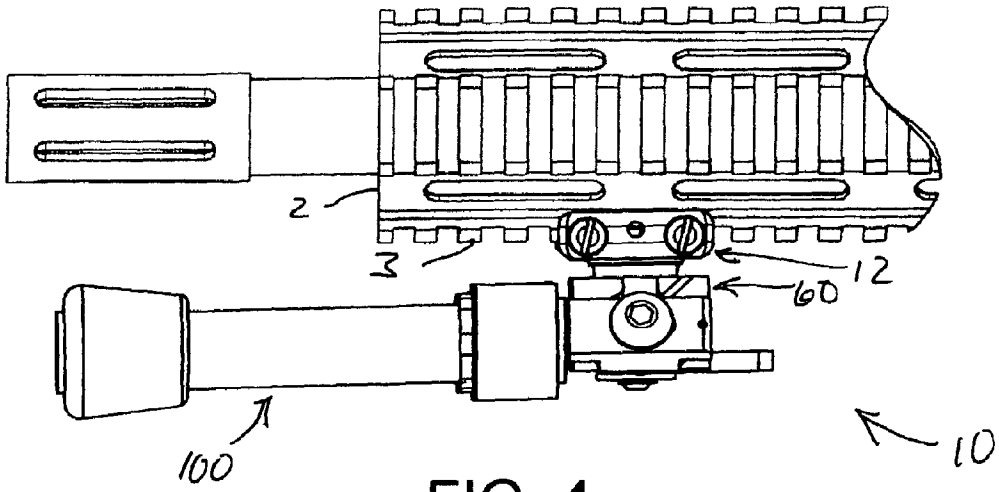
FIG. 4 is a side view of the bipod firearm support shown with the support legs in a level forward position and with the telescoping outside legs retracted.
Figure 5:
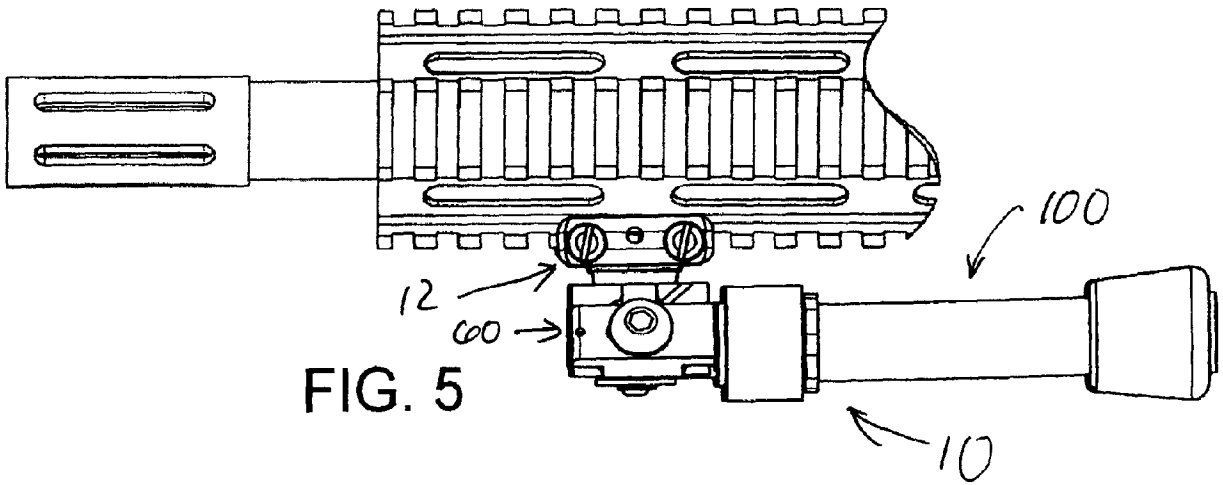
FIG. 5 is a side view of the bipod firearm support shown with the support legs in a level folded back position and with the telescoping outside legs retracted.

Each leg mounting surface 92 and each leg assembly 100 have corresponding features which cooperate to allow an operator to place a leg assembly in one of a small number of positions relative to pivot body 60, namely a generally upright position as shown in FIG. 2, an angled forward position as shown in FIG. 3, a folded forward position as shown in FIG. 4 and a folded back position as shown in FIG. 5. Both the folded forward and folded back positions allow bipod firearm support 10 to be mounted to a firearm in a very compact and retracted manner in which bipod firearm support 10 has a small cross section. The generally upright position shown in FIG. 2 and the angled forward position shown in FIG. 3 are for supporting a firearm during use. The generally upright position shown in FIG. 2 is useful for most shooting applications. The angled forward position shown in FIG. 3 might for example be used by a military sniper shooting from an elevated position.

The configuration of a leg mounting surface 92 can be best seen in FIG. 6A. As can be seen in FIG. 6A, leg mounting surface 92 includes a recess pattern 92A which further includes a center portion 92A and four radiating position channels 92B1, 92B2, 92B3 and 92B4 which communicate with center portion 92A1. Leg assembly 100 includes an inside leg 102 and a telescoping outside leg 120. Outside leg 120 will be described in greater detail below. Inside leg 102 includes a leg portion 103 and a head portion 104. Head portion 104 is pivotably mounted by a leg fastener 106 to a threaded bore 94 in pivot block 60 shown in FIG. 6A. Head portion 104 of inside leg 102 includes a slot 106 for accommodating leg fastener 106A. Inside leg 102 further includes an internal spring 106B for biasing between inside leg 102 and leg fastener 106A thus biasing inside 102 toward an extended position. The surface of head portion 104 which mates with mounting surface 92 includes a position feature 110 which is shaped to be received by any one of position channels 92B1, 92B2, 92B3 and 92B4 of leg mounting surface 92. Placing position feature 110 in position channel 92B1 locks leg assembly 100 in a folded forward position shown in FIG. 4. Placing position feature 110 in position channel 92B2 locks leg assembly 100 in the angled forward position shown in FIG. 3. Placing position feature 110 in position channel 92B3 locks leg assembly 100 in the upright position shown in FIGS. 1 and 2. Placing position feature 110 in position channel 92B4 locks leg assembly 100 in the folded back position shown in FIG. 5. An operator, by applying pressure against the spring biasing of inside leg 102 may pull a position feature 110 out of engagement with one of the position channels and then rotate inside leg 102 to another position and then release inside leg 102 to cause engagement of position feature 110 with another selected position channel.

Figure 8:
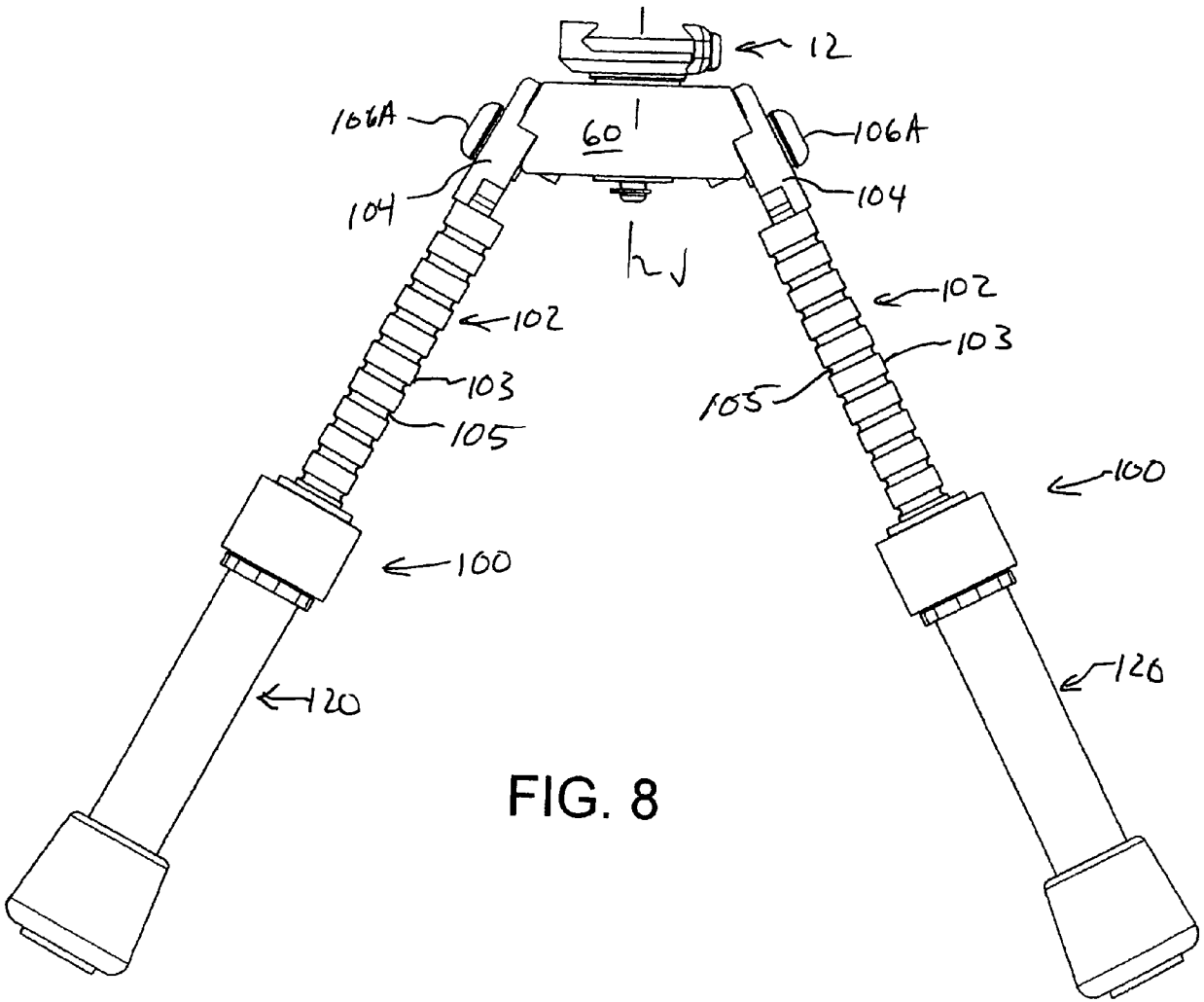
FIG. 8 is a front view of the bipod firearm support shown with the legs in an extended position.
Figures 9, 9A, 9B, 9C, 9D, 9E:
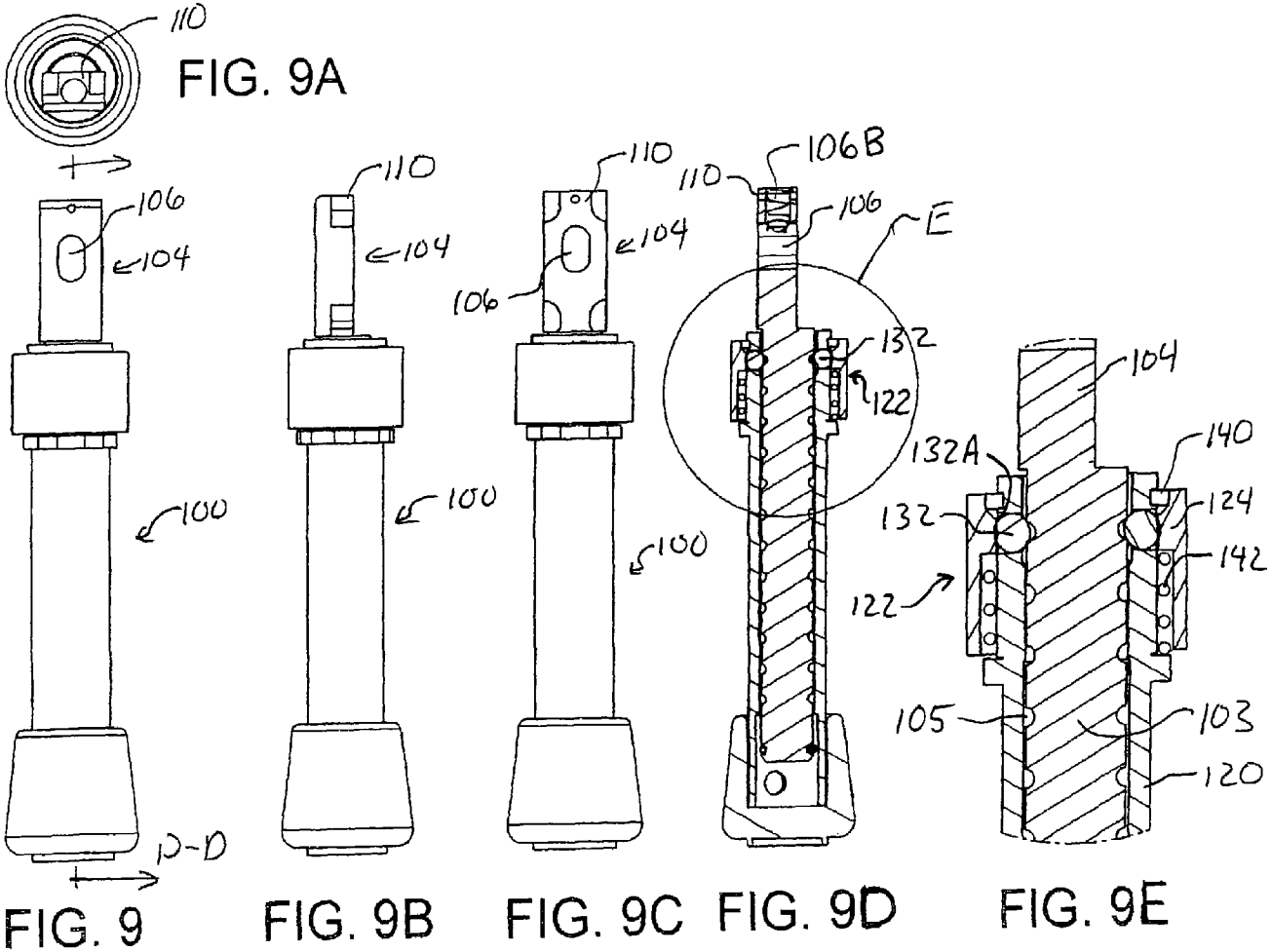
FIG. 9 is a side view of one leg of the bipod firearm support.
FIG. 9A is a top view of one leg of the bipod firearm support.
FIG. 9B is a second side view of one leg of the bipod firearm support.
FIG. 9C is a third side view of one leg of the bipod firearm support.
FIG. 9D is sectional view of one leg of the bipod firearm support taken from plane D-D of FIG. 9.
FIG. 9E is a magnified view of the region indicated by reference symbol D in FIG. 6C.

A third important capability of bipod firearm support 10 is the capability of adjusting the lengths of leg assemblies 100. As can be seen in FIGS. 8-9D each leg assembly 100 includes a inside leg 102 and an outside leg portion 120. In this example, outside leg portion 120 includes a ball bearing collar assembly 122. Ball bearing collar assembly 122 includes a collar 124 which is spring biased by a spring 142 toward an extended position. A retaining collar 140 retains collar 124. When collar 124 is biased in the extended position by spring 142, it urges a series of evenly spaced balls 132 toward the center of inside leg 102. Balls 132 are retained by pockets 132A spaced around the upper end of telescoping leg portion 120. Inside leg 102 includes a series of spaced grooves 105 as can be best seen in FIGS. 8, 9C and 9D. When collar 124 extends it urges ball bearings 132 into one of the series of spaced grooves 105 telescoping leg portion 120 is locked in relation to inside leg 102. When collar 124 is retracted, it no longer urges ball bearings 132 into spaced grooves 105 which allows ball bearings to disengage grooves 105 which in turn allows outside leg 120 to slide freely relative to inside leg 102.

As can be seen from the above description, the bipod firearm support accomplishes the objective set forth above. The leg assemblies are adjustable for both position and length and can be folded up in order to present a very compact unit for carrying with a firearm as can be seen in FIGS. 4 and 5. The clamp portion of the bipod firearm support is mounted to the remainder of the unit so that a marksman may pivot the mounted firearm about a generally vertical axis and a generally longitudinal axis to facilitate aiming.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. A bipod firearm support for supporting the forward portion of a firearm, comprising:

a clamp portion for clamping to a firearm, a pivot body mounted to said clamp portion, said clamp portion including a projecting ball portion and said pivot body including a socket member for receiving said projecting ball portion and a fastener common to said clamp portion and said pivot body for attaching said clamp portion to said pivot body, said clamp portion including a passageway for receiving said fastener, said pivot body also having a bore for receiving said fastener, the upper end of said fastener pivotably mounted to said clamp portion for rotation of said clamp portion relative to said pivot body about a longitudinal axis, said fastener passageway in said clamp portion widened in the transverse direction for passage of said fastener during said rotation of said clamp portion about said longitudinal axis, said fastener also carrying a pin which is generally perpendicular to said fastener, and said pivot body having a recess for receiving said pin, said recess sufficiently wide to allow limited rotation of said pin such that said clamp portion is capable of being rotated relative to said pivot body about a generally vertical axis between a first position and a second position, said pivot body further including two opposite outwardly angled leg mounting surfaces, each of said leg mounting surfaces having a recess pattern including at least three position channels corresponding to a first leg position in which the leg is in a folded position, a second leg position in which said leg is in an angled forward position with said leg angled away from the firearm suitable for supporting said firearm, and a third leg position in which the leg is in an upright position with said leg angled away from said firearm suitable for supporting said firearm, and two leg assemblies, each leg assembly independently mounted to one of said leg mounting surfaces of said pivot body, each leg assembly including a head portion for mounting to one said leg mounting surfaces of said pivot body by a leg fastener for rotation about an axis that is generally normal to said leg mounting surface, each said head portion having a leg position feature adapted for fitting into said position channels of said recess pattern of one said mounting surface, each leg assembly biased by a spring in a longitudinal direction relative to said leg assembly against said leg fastener toward a first locked position for engagement of said position feature with a position channel such that said leg assembly may be manually urged against said spring bias into a second unlocked position wherein said leg position feature is disengaged from one of said position channels, whereby each leg assembly may be urged to disengage from said first locked position to said second unlocked position for rotating said leg assembly between said first leg position, said second leg position and said third leg position.

2. A bipod firearm support of claim 1, wherein the lower end of said fastener is threaded and wherein a nut lever is threaded onto said lower end of said fastener for tightening and loosening fastener tension for securing said pivot body to said clamp portion.

3. A bipod firearm support of claim 1, wherein, each said leg assembly includes an inside leg and an outside leg and said outside leg telescopes between a first retracted position and a second extended position to adjust the length of said leg assembly.

4. A bipod firearm support of claim 1, wherein, each said leg assembly includes an inside leg and an outside leg and said outside leg telescopes between a first retracted position and a second extended position to adjust the length of said leg assembly and wherein said outside leg further includes ball and collar assembly including balls retained in pockets and collar for urging said balls toward said inside leg and said inside leg further includes a plurality of spaced grooves for receiving said balls for locking the position of said outside leg relative to said inside leg in one of a plurality of positions between said first retracted position and said second extended position.

* * * * *